US007570162B2

(12) United States Patent
Leyden et al.

(10) Patent No.: US 7,570,162 B2
(45) Date of Patent: Aug. 4, 2009

(54) ILLUMINATED SENSOR FOR SECURITY SYSTEM

(75) Inventors: Roger Leyden, Inverness, IL (US); Terrance Surma, Carol Stream, IL (US); Kris Michael Southerland, Palatine, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 140 days.

(21) Appl. No.: 11/716,867

(22) Filed: Mar. 12, 2007

(65) Prior Publication Data

US 2008/0224865 A1 Sep. 18, 2008

(51) Int. Cl.
*G08B 13/14* (2006.01)

(52) U.S. Cl. ..... 340/568.1; 340/571; 362/311; 362/362

(58) Field of Classification Search ... 340/568.1–568.8, 340/571; 362/311, 351, 355, 362, 800
See application file for complete search history.

(56) References Cited

U.S. PATENT DOCUMENTS

| | | | | |
|---|---|---|---|---|
| 4,455,464 | A | 6/1984 | Leyden | |
| 5,172,098 | A | 12/1992 | Leyden et al. | |
| 5,341,124 | A | 8/1994 | Leyden et al. | |
| 5,552,771 | A | 9/1996 | Leyden et al. | |
| 5,565,848 | A | 10/1996 | Leyden et al. | |
| 5,861,807 | A | 1/1999 | Leyden et al. | |
| 5,936,525 | A | 8/1999 | Leyden et al. | |
| 6,027,277 | A | 2/2000 | Leyden et al. | |
| 6,039,498 | A | 3/2000 | Leyden et al. | |
| 6,087,939 | A | 7/2000 | Leyden et al. | |
| RE37,590 | E | 3/2002 | Leyden et al. | |
| 6,756,900 | B2 | 6/2004 | Leyden et al. | |
| 6,946,961 | B2 | 9/2005 | Frederiksen et al. | |
| 2003/0128118 | A1 * | 7/2003 | Leyden et al. | 340/568.2 |
| 2007/0001845 | A1 * | 1/2007 | Ott | 340/568.1 |
| 2007/0091614 | A1 * | 4/2007 | Kaisser et al. | 362/326 |
| 2007/0107477 | A1 * | 5/2007 | Fawcett et al. | 70/57.1 |
| 2008/0064265 | A1 * | 3/2008 | Sterling et al. | 439/660 |
| 2008/0137342 | A1 * | 6/2008 | Portor | 362/295 |
| 2008/0165547 | A1 * | 7/2008 | Amor et al. | 362/373 |
| 2008/0224865 | A1 * | 9/2008 | Leyden et al. | 340/568.1 |

FOREIGN PATENT DOCUMENTS

WO WO 2006/094346 A1 * 9/2006

* cited by examiner

*Primary Examiner*—John R Lee
(74) *Attorney, Agent, or Firm*—Wood, Phillips, Katz, Clark & Mortimer

(57) ABSTRACT

A security system having a control and a sensor attachable to an article to be monitored. The sensor has a plurality of different states, among which are an armed state and a breached state. The sensor and control interact so that the control causes a detectable signal to be generated as an incident of the sensor being changed from the armed state into the breached state. The sensor has a housing with a wall structure bounding a cavity. The sensor further has a source of illumination that projects light. The wall structure has a light transmissive portion through which light from the illumination source projects from within the cavity to be visible externally of the wall structure.

27 Claims, 3 Drawing Sheets

ILLUMINATED SENSOR FOR SECURITY SYSTEM

BACKGROUND OF THE INVENTION

1. Field of the Invention

This invention relates to security systems and, more particularly, to a security system having a sensor attached to an article to be monitored, and which sensor has an illumination source that gives a visual indication as to a state of the system, or a component thereof.

2. Background Art

The proliferation of consumer electronic devices has presented a unique challenge to the security industry. In large electronic stores, a multitude of different types and brands of consumer electronic devices are displayed for interactive handling by potential consumers. The miniaturization of electronic devices makes them ready targets for thieves. Many sophisticated, expensive, hand held electronic devices are now of a size that they can be discretely hidden on the person of a thief and removed from the premises upon which they are displayed without detection, in the absence of some sort of safeguards.

Because of the cost of many of these components, purveyors thereof commonly invest in relatively sophisticated electronic security systems for these devices. It is common for a dozen or more of such devices to be exhibited simultaneously for handling at a single display location. At any such location, a single control unit may be utilized for a plurality of sensors, secured one each to the articles being monitored. In a typical display setup, the control unit will be hidden from view and hard-wire connected to the sensors.

The assignee herein has developed numerous electronic security systems with varying features and capabilities. One of the most common designs utilizes an illumination source, generally in the form of an LED, on each sensor to allow an individual monitoring the system to identify the state of a particular sensor and/or the overall system. In one form, one or more LED's is provided on the sensor such that illumination with a first color indicates one state, while illumination with a second color indicates a second state, of the sensor/system.

In a typical sensor construction, a sensor housing is squared or rounded in nature with an effective diameter on the order of one inch. The housing has an internal space adequate to contain circuit components, among which typically is a switch through which the sensor can be placed in a secured state, as an incident of being attached to the particular article being monitored. The housing also supports one or more LED's that is illuminated to visually indicate the state of the sensor and/or the overall system.

The exposed portion of the LED's has a relatively small area compared to that of the sensor housing. LED's, by their nature, are desirable by reason of their compact configuration and ability to project a relatively intense light. While the small size of the LED's is in one respect an advantage, their size has a detrimental aspect.

On large displays, where there are many different articles and wires connecting to the sensors, viewing of the LED's may become obscured. This is particularly a problem with respect to system monitoring by individuals assigned that task. At initial setup, as at the beginning of a business day, the overall armed state of the system, and secured/armed state of all sensors, may have to be verified by visually observing the illumination of the appropriate LED(s). In a large display, that may be cluttered by articles, wires, and other miscellaneous objects, it may be difficult to observe each LED on each article. Individuals responsible for monitoring displays may not give the appropriate attention to this task and may, for example, give a casual glance over a display without verifying the desired state of the sensors on each article. Consequently, it may go unnoticed that one or more of the sensors has not been properly installed or placed in a secured/armed state, as a result of which the associated article may be separated from the display without any detection thereof by the security system.

Another limitation with existing sensor constructions is that the LED's are permanently wired with respect to the housing and, consequently, a system user has no flexibility with respect to changing colors resulting from illumination that may reflect different states of the sensor and/or system.

The industry continues to seek out affordable and versatile systems that will be consistently and reliably set up by the end users and that will effectively permit monitoring of portable articles with which the systems are used.

SUMMARY OF THE INVENTION

In one form, the invention is directed to a security system having a control and a sensor attachable to an article to be monitored. The sensor has a plurality of different states, among which are at least an armed state and a breached state. The sensor and control interact so that the control causes a detectable signal to be generated as an incident of the sensor being changed from the armed state into the breached state. The sensor has a housing with a wall structure bounding a cavity. The sensor further has a source of illumination that projects light. The wall structure has a light transmissive portion through which light from the illumination source projects from within the cavity to be visible externally of the wall structure. The source of illumination projects light from within the cavity through the light transmission portion with the sensor in at least one of the plurality of states to thereby provide a visual indication externally of the wall structure that the sensor is in the at least one of the plurality of different states.

In one form, the source of illumination is capable of projecting first and second different colors of light from within the cavity through the light transmissive portion to be visible externally of the wall structure. The source of illumination projects one color light with the sensor in one of the plurality of different states and a second color light with the sensor in a second of the plurality of different states, that is different than the one of the plurality of different states.

In one form, the source of illumination is in the form of an LED.

The LED may be capable of generating first and second different color lights that each projects through the light transmissive portion.

In one form, the light transmissive portion is made from a white translucent material.

In one form, the source of illumination is capable of generating at least three different color lights that each projects through the light transmissive portion. The projection of the three different color lights is indicative of three different states of the sensor.

In one form, the wall structure on the housing consists of a top wall, a bottom wall, and a peripheral wall between the top and bottom walls. The light transmissive portion is on at least the peripheral wall.

Alternatively, the light transmissive portion may be on at least the top wall.

In one form, substantially the entirety of the top and peripheral walls is light transmissive and defines the light transmissive portion.

In one form, the sensor has a switch with first and second different states. The sensor has an unsecured state. The switch is changed from the first state into the second state as an incident of the sensor being operatively adhered to an article to be monitored. The sensor is changed from the unsecured state into a secured state as an incident of the switch being changed from the first state into the second state.

In one form, the sensor housing has a base portion and a first separable section that defines at least a part of the light transmissive portion.

The sensor may be provided in combination with a second separable section that is interchangeably mountable to the base portion with the first separable section. The first and second separable sections have different light transmission capabilities.

In one form, the sensor and control are operatively interconnected through at least one conductive element.

In one form, the source of illumination is a bulb within the cavity.

The housing may have one of a squared shape and a cylindrical shape.

In one form, the housing has an effective diameter that is at least ½ inch.

The invention is further directed to a sensor for a security system. The sensor has a housing with a wall structure bounding a cavity. The sensor housing is attachable to an article to be monitored and has plurality of different states, among which are at least an unsecured state, an armed state and a breached state. The sensor further has a source of illumination that projects light. The wall structure has a light transmissive portion through which light from the illumination source projects from within the cavity to be visible externally of the wall structure. The source of illumination projects light from within the cavity through the light transmissive portion, with the sensor in at least one of the plurality of states, to thereby provide a visual indication externally of the wall structure that the sensor is in the at least one of the plurality of different states. The sensor is configured to be attached to an article to be monitored as an incident of which the sensor is changed from the unsecured state into a secured state. The sensor is configured to interact with a control to cause a detectable signal to be generated as an incident of the sensor being changed from the unsecured state into the breached state.

In one form, the source of illumination is capable of projecting first and second different colors of light from within the cavity through the light transmissive portion to be visible externally of the wall structure. The source of illumination projects one color light with the sensor in one of the plurality of different states and a second color light with the sensor in a second of the plurality of different states, that is different than the one of the plurality of different states.

In one form, the light transmissive portion is made from a white translucent material.

The source of illumination may be capable of generating at least three different color lights that each projects through the light transmissive portion. The projection of the three different color lights is indicative of three different states of the sensor.

In one form, the wall structure on the housing consists of a top wall, a bottom wall, and a peripheral wall between the top and bottom walls. The light transmissive portion is on at least the peripheral wall.

In an alternative form, the light transmissive portion is on at least the top wall.

In one form, the sensor housing has a base portion and a first separable section that defines at least a part of the light transmissive portion.

The sensor may be provided in combination with a second separable section that is interchangeably mountable to the base portion with the first separable section. The first and second separable sections have different light transmission capabilities.

The source of illumination may be a bulb within the cavity.

DETAILED DESCRIPTION OF THE DRAWINGS

Figure 1:
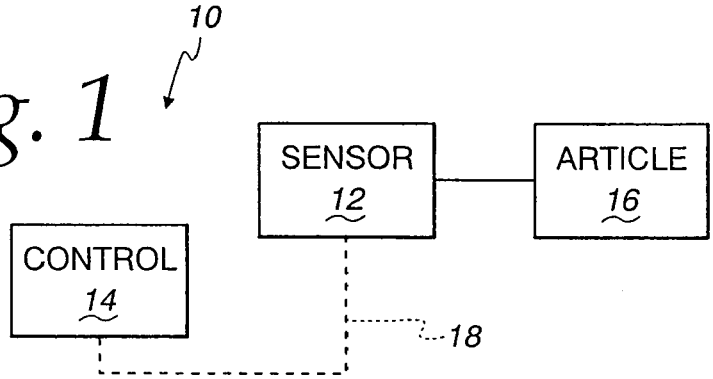
FIG. 1 is a schematic representation of a security system, according to the present invention, including a sensor attached to an article to be monitored and interacting with a control.

In FIG. 1, a security system, of the type suitable for incorporation of the present invention, is shown at 10, and consists of a sensor 12 and a control 14. The sensor 12 is attachable to an article 16 to be monitored.

The sensor 12 has a plurality of different states, among which may be at least an unsecured state, a secured state, an armed state, and a breached state. The sensor 12 and control 14 interact so that the control 14 causes a detectable signal to be generated through the sensor 12, and potentially elsewhere, as an incident of the sensor 12 being changed from the secured and armed states into the breached state. The sensor 12 and control 14 may interact wirelessly, or through at least one conductive element, as indicated in dotted lines at 18.

Details of the operation of the sensor 12, the nature of the control 14, and the interaction of the sensor 12 and control 14 are not critical to the present invention and will not be set out herein. A multitude of different variations have been developed for the sensor 12 and control 14, that are operable consistently with the present invention. Exemplary structures for the sensor 12 and control 14 are shown, for example, in assignee's U.S. Pat. No. 4,455,464, entitled "Alarm System Sensing and Triggering Apparatus"; U.S. Pat. No. 5,172,098, entitled "Alarm System Sensing and Triggering Apparatus"; U.S. Pat. No. 5,341,124, entitled "Mountable Product Sensor and Display Stand"; U.S. Pat. No. 5,552,771, entitled "Retractable Sensor for an Alarm System"; U.S. Pat. No. 5,565,848, entitled "Security Apparatus for Monitoring an Article"; U.S. Pat. No. 5,861,807, entitled "Security System"; U.S. Pat. No. 5,936,525, entitled "Sensor for Monitoring an Article"; U.S. Pat. No. 6,027,277, entitled "Security System"; U.S. Pat. No. 6,039,498, entitled "Security System"; U.S. Pat. No. 6,087,939, entitled "Security System"; Re. 37,590, entitled "Retractable Sensor for an Alarm System"; U.S. Pat. No. 6,756,900, entitled "Voltage Selectable Alarm Sensor"; and U.S. Pat. No. 6,946,961, entitled "Security System with Mechanism for Controlling Cord Twisting", the disclosures of which are incorporated herein by reference. While one specific form of sensor will be described hereinbelow, it should be understood that the invention is not limited to this or any specific structure shown in those documents incorporated herein by reference.

Figure 2:
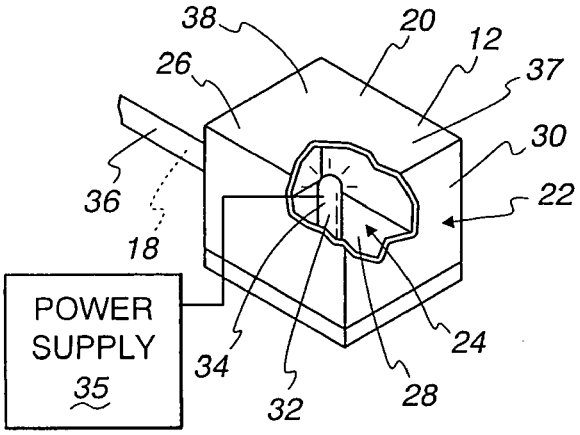
FIG. 2 is perspective view of one form of the sensor in FIG. 1 having a housing that is broken away to expose a source of illumination that projects light through a light transmissive portion of the housing.
Figure 3:
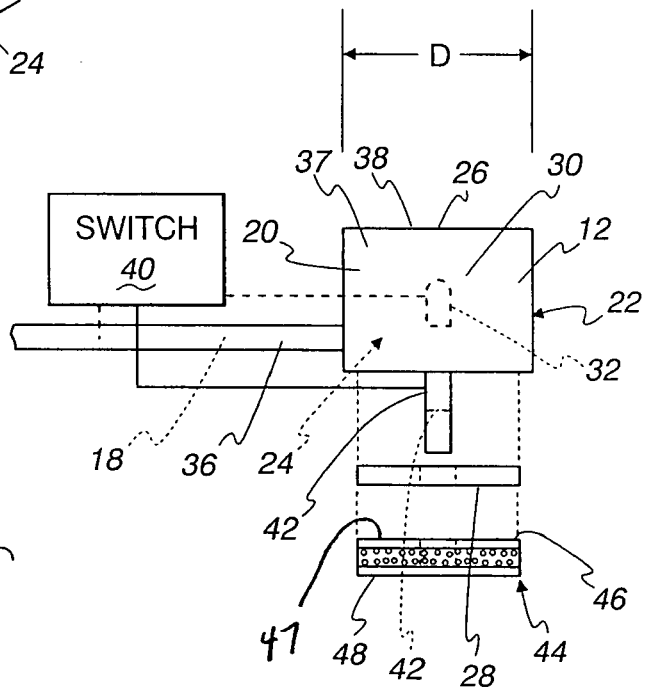
FIG. 3 is a partially exploded, elevation view of the sensor in FIG. 2.
Figure 4:
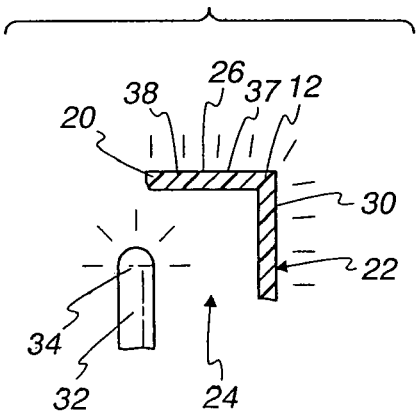
FIG. 4 is an enlarged, fragmentary, cross-sectional view of a part of the housing in FIGS. 2 and 3, in relationship to the illumination source.

In FIGS. 2-4, the sensor 12 is shown with a squared housing 20 with a wall structure 22 bounding a cavity 24 within which various electrical and mechanical operating components (not shown) for the sensor reside. The wall structure 22 consists of a top wall 26, a bottom wall 28 and a peripheral wall 30 between the top and bottom walls 26, 28. In this embodiment, the top wall 26 and peripheral wall 30 are formed as one inverted, cup-shaped piece, whereas the bottom wall 28 is a separate element that functions as a base that is joinable to the peripheral wall 30. It is also contemplated that the bottom wall/base 28 could be permanently affixed to the peripheral wall 30 at time of manufacture or that components be joinable in another fashion to produce the housing 20.

Within the cavity 24, a source of illumination 32 is provided. The source of illumination 32 may take any of a number of different forms, which may be, for example, incandescent in nature. In a preferred form, the source of illumination 32 is an LED capable of producing by itself one or multiple colors of light. Regardless of the form of the source of illumination 32, it is preferred, but not necessary, that there be a self-contained unit with an encapsulating bulb 34 within the cavity 24.

The source of illumination 32 may be powered by a supply 35, directly upon the sensor 12, or through the conductive element 18 or other conductive element(s) on a cord 36 connecting between the sensor 12 and control 14. The structure within the sensor 12 required to power the source of illumination 32 is not critical to the present invention and will not be described herein.

According to the invention, part a portion 37, or the entirety, of the top wall 26 and/or the bottom wall/base 28 of the housing 20 is made to be light transmissive. The portion 37 of the housing 20 that is light transmissive is in relationship to the source of illumination 32 so that light from the source of illumination 32 projects from within the cavity 24 through the light transmissive portion 37 of the housing 20 to be visible externally of the wall structure 22. Whereas the source of illumination 32, as an LED, has a relatively small light projecting area, by projecting light through the light transmissive portion 37 of the housing 20, the light projects visibly from a larger area as defined by the light transmissive portion 37 thereof and disperses outwardly therefrom. Preferably, substantially the entirety of the top wall 26 and peripheral wall 30 are made light transmissive so that light projected from the source of illumination 32 illuminates substantially the entire area of the exposed, external surface 38 of the top and peripheral walls 26, 30. With the light transmissive portion 37 being defined by substantially the entirety of the top wall 26 and peripheral wall 30, the appearance from externally thereof is that the entire housing 20 is "glowing".

The significance of having a substantial portion of the, or the entire, housing 20 illuminated is two-fold. First of all, this makes the sensor 12 and its color highly visible to an individual that is responsible for monitoring a display on which the sensor 12 is used. Whereas the visible state of a small LED may be missed or obscured on a display, the illuminated housing 20 is more eye catching and less likely to be missed. Secondly, the dominant appearance of the illuminated housing 20 will be seen by a would-be thief, thereby making obvious to such an individual(s) that a security system is in place and apparently armed.

Typically, the housing 20 will have an effective diameter D, which circumscribes the peripheral wall 30, that is at least equal to ½ inch. Commonly, the dimension D is substantially larger and may be around, or in excess of, 1 inch. Thus, a highly visible, eye catching structure potentially results when the housing 20 is illuminated by reason of the projection of light from the source of illumination 32.

To afford the desired light transmission capabilities, the portion 37 of the housing 20 that is light transmissive may be made from a translucent material, such as plastic. In one preferred form, the plastic is white in color to effectively transmit, without appreciably changing, the color(s) projected by the source of illumination 32. For example, it is common to cause the source of illumination 32 to project a green light indicative of the unarmed state of the system 10. The source of illumination 32 may project a red light indicating an armed state for the sensor 12 and/or the system. Translucent material, such as one with a white color, allows the projection of the green and red lights without materially altering their appearance, while at the same time obscuring clear viewing of the source of illumination 32 through the housing 20. While it is preferable that the source of illumination 32 be obscured, the light transmissive portion may be transparent, which for purposes herein is intended to be encompassed by the characterization "translucent".

The material in the light transmissive portion 37 may be selectively modified to produce different, desired visual effects. For example, the material may be defined as a lens to selectively focus the projected light. The material may be chosen with a density and structure that may produce any of a number of potentially unlimited light projection patterns.

Also, the projection angle of light for the element(s) on the source of rumination may be selected to produce a desired light pattern. For example, LED's are currently available with different light projection ranges/patterns.

In the exemplary construction shown in FIGS. 2-4, a switch 40 is provided on the sensor 12 and has first and second different states. An actuator 42 is repositionable relative to the housing 20 between a first position, shown in solid lines, and a second, depressed position, indicated by dotted lines in FIG. 3. With the actuator 42 in the first position, the sensor is in an unsecured state. In the second position for the actuator 42, the sensor 12 is in a secured state, in which the sensor 12 can further be placed in an armed state through the control 14, with the control 14 set appropriately for system operation. By changing the actuator 42 from its first position into its second position, the switch 40 is changed from a first state into a second state, as an incident of which the sensor is changed from the unsecured state into the secured state. Preferably, the switch 40 in the secured state causes the source of illumination 32 to project light of a first color through the light transmissive portion 37 of the housing 20, thereby giving a visual indication that the sensor 12 is in the secured state, and potentially armed. With the switch in the first state, the source of illumination 32 may be deactivated or caused to project light though the light transmissive portion of the housing 20 of a color that is different than the one color indicative of the secured/armed state.

In this particular embodiment, the actuator 42 projects through the bottom wall/base 28 and a double-sided adhesive pad 44 having one side 47 thereof secured to the bottom wall/base 28. The opposite side 48 of the double-sided adhesive pad 44 is attached to the article 16. The actuator 42 has a length sufficient to project through the bottom wall/base 28 and the double-sided adhesive pad 44. By reason of attaching the sensor 12 to the article 16 through the double-sided adhesive pad 44, the actuator 42 is captively depressed, and thereby changed from its first position into its second position, in turn causing the switch 40 to be changed from its first state into its second state, and as an incident thereof, causing the sensor 12 to be changed from the unsecured state into the secured state. Other means for attaching the sensor 12 are also contemplated.

Figure 5:
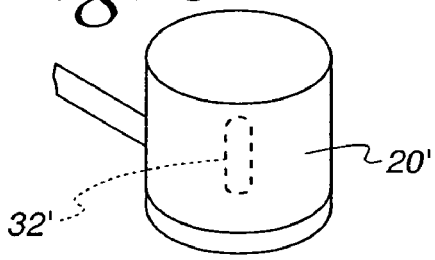
FIG. 5 is a view as in FIG. 2 of a modified form of sensor having a different housing shape.

In FIG. 5, an alternative configuration of housing 20' is shown that has a cylindrical shape. The housing 20' otherwise performs the same function of the housing 20, in association with a corresponding source of illumination 32' and switching components (not shown). That is, the housing 20' has light transmissive portions to pass light projected from the source of illumination 32' to externally of the housing 20', giving the appearance that the entire housing 20' is glowing.

Figure 6:
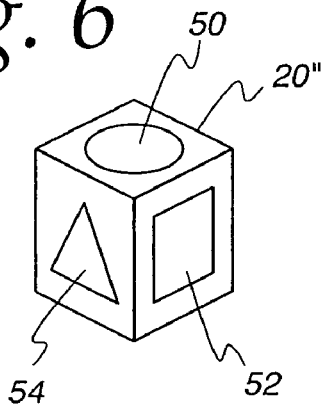
FIG. 6 is a view as in FIG. 2 of a further modified form of sensor wherein there are discrete light transmissive portions on the housing.

The invention contemplates many variations from the basic structure described above. As one example, as shown in FIG. 6, discrete, light transmissive portions 50, 52, 54 may be provided on the housing 20". A single such portion, or more than the three portions shown, might be incorporated. Shape and number is not critical.

As a further alternative, in FIGS. 2-4, part or all of the top wall 26 may define the light transmissive portion 37, with the peripheral wall 30 not being light transmissive. Alternatively, part or all of the peripheral wall 30 can define the light transmissive portion 37, with the top wall 26 not being light transmissive. Other combinations of light transmissive portions and non-light transmissive portions are contemplated. Light transmissive portions on different parts of the housing 20 may be made with different light transmission capabilities, i.e. different colors, different degrees of translucency, focusing characteristics, etc.

Figure 7:
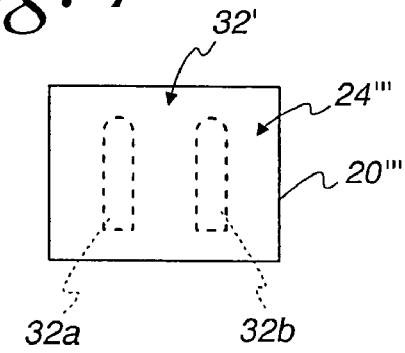
FIG. 7 is a side elevation view of a further modified form of sensor wherein a source of illumination includes separate illumination source elements.

The invention also contemplates that the source of illumination 32' may actually include multiple, and separate, source elements, shown for example at 32*a* and 32*b* in FIG. 7. The source elements 32*a*, 32*b* are both shown in the same cavity 24'" on the housing 20'".

Figure 8:
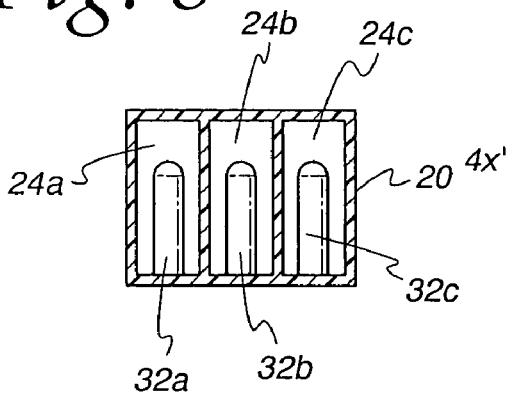
FIG. 8 is a cross-sectional view of a further modified form of sensor having separate cavities in which separate illumination source elements are provided.
Figure 9:
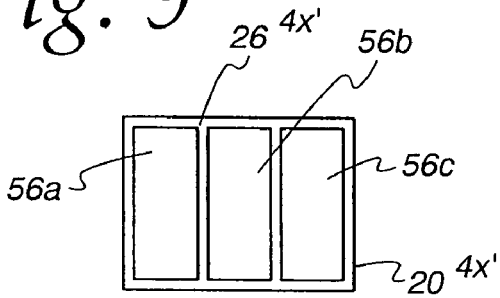
FIG. 9 is a plan view of the sensor in FIG. 8.
Figure 10:
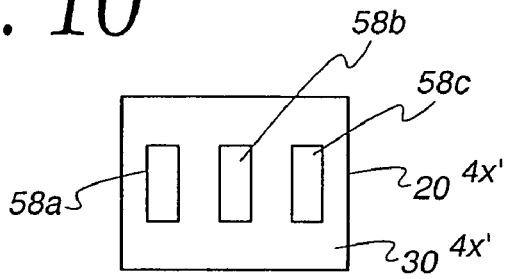
FIG. 10 is a side elevation view of the sensor in FIGS. 8 and 9.

While the illumination sources 32, 32' are shown in a single cavity 24, 24'", multiple cavities 24*a*, 24*b*, 24*c* may be provided for a single housing $\mathbf{20}^{4x'}$, as shown in FIGS. 8-10. Each cavity 24*a*, 24*b*, 24*c* has an illumination source element 32*a*, 32*b*, 32*c*.

Light from the illumination source 32*a* projects through a light transmissive portion 56*a* in the top wall $\mathbf{26}^{4x'}$ and a light transmissive portion 58*a* in the peripheral wall $\mathbf{30}^{4x'}$. Likewise, light from the illumination source element 32*b* projects through light transmissive portions 56*b*, 58*b*, with light from the illumination source element 32*c* projecting though light transmissive portions 56*c*, 58*c*.

The light from each illumination source element 32*a*, 32*b*, 32*c* that is projected through the housing $\mathbf{20}^{4x'}$ can be different by reason of a different light color originating from the illumination source elements 32*a*, 32*b*, 32*c* and/or by reason of the translucent portions 56*a*, 58*a*, 56*b*, 58*b*, 56*c*, 58*c* having different light transmission properties, be it different colors, translucency, etc. Each different color can be representative of a different state of the sensor/system, be it unsecured, secured, armed, or breached. Additional states, such as a malfunction state, might be visually identified in another distinct manner. The state of the sensor 12 might also give a light visual indication that a product has been handled, as by being repositioned relative to a support therefor. Other states for the sensor 12/system 10 are contemplated to be identifiable by the projection of a particular color through and from the associated housing.

Figure 11:
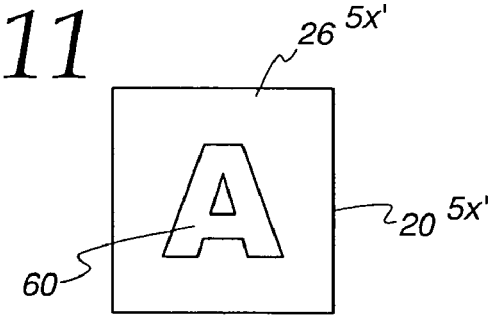
FIG. 11 is a plan view of a top wall of a housing on a modified form of sensor, wherein a light transmissive portion is formed in the shape of a letter.

As a further modification, as shown in FIG. 11, the housing $\mathbf{20}^{5x'}$ may have strategically configured light translucent portions, as shown at 60, in this case in the top wall $\mathbf{20}^{6x'}$. In this embodiment, the letter "A" is defined by a discrete translucent portion in the top wall $\mathbf{26}^{5x'}$. The illumination of the letter "A" may occur in the event that the system is armed. Like, or different indicia, might be provided to more demonstratively identify the state of the sensor 12 and/or overall system 10.

Figure 12:
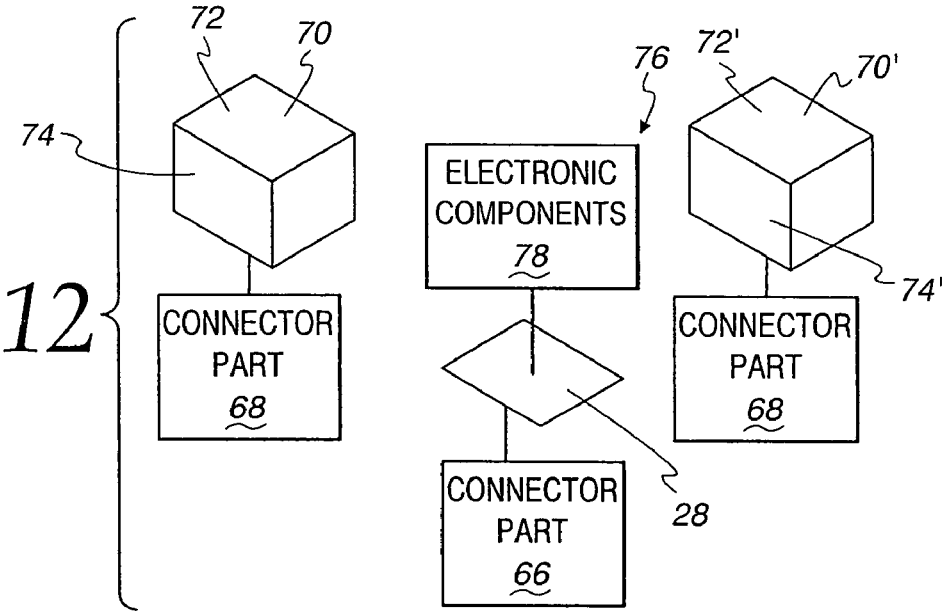
FIG. 12 is a perspective view of a kit, according to the present invention, including interchangeable housing parts having different light transmission capabilities, and which are interchangeably mountable to a base, one in place of the other.

In a further modified form of the invention, as shown in FIG. 12, the bottom wall/base portion 28 can be provided with a connector part 66 that cooperates in like fashion with connector parts 68, 68' on housing parts 70, 70', each consisting of a top wall 72, 72' in an integrally formed peripheral wall 74, 74', having potentially the same configuration as shown for the top wall 26 and peripheral wall 30 on the sensor 12 in FIGS. 2-4. The housing parts 70, 70' are selectively interchangeably and separably, operably mountable to the bottom wall/base portion 28 through the connector parts 66 and 68, 68'. The base portion 76 may consist of the bottom wall 28 and electronic components 78 required for operation, including a source of illumination. The housing portions 70, 70' may have different light transmission capabilities, whereby a user can select a desired light projection characteristic afforded by the particular housing part 70.

The foregoing disclosure of specific embodiments is intended to be illustrative of the broad concepts comprehended by the invention.

The invention claimed is:

1. A security system comprising:

a control; and a sensor attachable to an article to be monitored, the sensor having a plurality of different states among which are at least an armed state and a breached state, the sensor and control interacting so that the control causes a detectable signal to be generated as an incident of the sensor being changed from the armed state into the breached state, the sensor having a housing comprising a wall structure bounding a cavity, the sensor further comprising a source of illumination that projects light, the source of illumination comprising an encapsulating bulb that is separate from the wall structure on the housing, the wall structure comprising a portion made from a light transmissive material through which light from the illumination source projects from within the cavity to be visible externally of the wall structure over a substantial area thereof, the source of illumination projecting light from within the cavity through the light transmissive portion with the sensor in at least one of the plurality of states to thereby provide a visual indication externally of the wall structure that the sensor is in the at least one of the plurality of different states.

2. The security system according to claim 1 wherein the source of illumination is capable of projecting first and second different colors of light from within the cavity through the light transmissive portion to be visible externally of the wall structure, the source of illumination projects one color light with the sensor in one of the plurality of different states and a second color light with the sensor in a second of the plurality of different states that is different than the one of the plurality of different states.

3. The security system according to claim 1 wherein the source of illumination comprises at least one LED that resides fully within the cavity.

4. The security system according to claim 1 wherein the source of illumination comprises at least one LED capable of generating first and second different color lights to project through the light transmissive portion.

5. The security system according to claim 4 wherein the light transmissive portion is made from a white translucent material.

6. The security system according to claim 1 wherein the source of illumination is capable of generating at least three different color lights that each projects through the light transmissive portion with the projection of the three different color lights indicative of three different states of the sensor.

7. The security system according to claim 1 wherein the wall structure on the housing comprises a top wall, a bottom wall with a surface with a substantial area to be placed against an article to be monitored, and a peripheral wall between the top and bottom walls and the light transmissive portion is on at least the peripheral wall.

8. The security system according to claim 1 wherein the wall structure on the housing comprises a top wall, a bottom wall with a surface with a substantial area to be placed against an article to be monitored, and a peripheral wall between the top and bottom walls and the light transmissive portion is on at least the top wall.

9. The security system according to claim 1 wherein the wall structure on the housing comprises a top wall, a bottom wall with a surface with a substantial area to be placed against an article to be monitored, and a peripheral wall between the top and bottom walls, and substantially the entirety of the top and peripheral walls is light transmissive and defines the light transmissive portion.

10. The security system according to claim 1 wherein the sensor comprises a switch with first and second different states, the sensor has an unsecured state, and the switch is changed from the first state into the second state as an incident of the sensor being operatively adhered to an article to be monitored, and the sensor is changed from the unsecured state into a secured state as an incident of the switch being changed from the first state into the second state.

11. The security system according to claim 1 wherein the sensor housing comprises a base portion and a first separable section that defines at least a part of the light transmissive portion.

12. The security system according to claim 11 in combination with a second separable section that is interchangeably mountable to the base portion with the first separable section, the first and second separable sections having different light transmission capabilities.

13. The security system according to claim 1 wherein the sensor and control are operatively interconnected through at least one conductive element.

14. The security system according to claim 1 wherein the source of illumination resides fully within the cavity.

15. The security system according to claim 1 wherein the housing has one of a: a) squared shape; and b) a cylindrical shape.

16. The security system according to claim 1 wherein the housing has an effective diameter that is at least ½ inch.

17. A sensor for a security system, the sensor comprising:

a housing comprising a wall structure bounding a cavity, the sensor housing attachable to an article to be monitored and having a plurality of different states, among which are at least an unsecured state, an armed state and a breached state, the sensor further comprising a source of illumination that projects light, the wall structure comprising a light transmissive portion with a substantial area through which light from the illumination source projects from within the cavity to be visible externally of the wall structure, the source of illumination projecting light from within the cavity through the light transmissive portion with the sensor in at least one of the plurality of states to thereby provide a visual indication externally of the wall structure that the sensor is in the at least one of the plurality of different states, the sensor configured to be attached to an article to be monitored as an incident of which the sensor is changed from the unsecured state into a secured state, the sensor configured to interact with a control to cause a detectable signal to be generated as an incident of the sensor being changed from the armed state into the breached state, wherein the wall structure on the housing comprises a top wall, a bottom wall with a surface with a substantial first area to be placed against an article to be monitored, and a peripheral wall between the top and bottom walls, the top wall having a second area. approximately the same as the first area, that remains exposed to view with the sensor attached to an article to be monitored, wherein the light transmissive portion is on at least the top wall.

18. The sensor for a security system according to claim 17 wherein the source of illumination is capable of projecting first and second different colors of light from within the cavity through the light transmissive portion to be visible externally of the wall structure, the source of illumination projects one color light with the sensor in one of the plurality of different states and a second color light with the sensor in a second of the plurality of different states that is different than the one of the plurality of different states.

19. The sensor for a security system according to claim 17 wherein the light transmissive portion is made from a white translucent material.

20. The sensor for a security system according to claim 17 wherein the source of illumination is capable of generating at least three different color lights that each projects through the light transmissive portion with the projection of the three different color lights indicative of three different states of the sensor.

21. The sensor for a security system according to claim 17 wherein the light transmissive portion is on the peripheral wall.

22. The sensor for a security system according to claim 17 wherein the light transmissive portion defines substantially the entirety of the top wall and peripheral wall.

23. The sensor for a security system according to claim 17 wherein the sensor housing comprises a base portion and a first separable section that defines at least a part of the light transmissive portion.

24. The sensor for a security system according to claim 23 in combination with a second separable section that is interchangeably mountable to the base portion with the first separable section, the first and second separable sections having different light transmission capabilities.

25. The sensor for a security system according to claim 17 wherein the source of illumination comprises a self-contained unit with an encapsulating bulb within the cavity.

26. The security system according to claim 1 wherein the cavity is configured to contain operating components for the sensor in addition to the source of illumination.

27. The sensor for a security system according to claim 17 wherein the cavity is configured to contain operating components for the sensor in addition to the source of illumination.

* * * * *